US011011031B2

(12) United States Patent
Suzuki et al.

(10) Patent No.: US 11,011,031 B2
(45) Date of Patent: May 18, 2021

(54) TOOL AND ELECTRIC TOOL

(71) Applicant: MAX CO., LTD., Tokyo (JP)

(72) Inventors: Takashi Suzuki, Tokyo (JP); Teruaki Andou, Tokyo (JP); Takayuki Masuno, Tokyo (JP)

(73) Assignee: MAX CO., LTD., Tokyo (JP)

( * ) Notice: Subject to any disclaimer, the term of this patent is extended or adjusted under 35 U.S.C. 154(b) by 43 days.

(21) Appl. No.: 16/170,118

(22) Filed: Oct. 25, 2018

(65) Prior Publication Data

US 2019/0130708 A1 May 2, 2019

(30) Foreign Application Priority Data

Oct. 26, 2017 (JP) ..... JP2017-206760
Aug. 23, 2018 (JP) ..... JP2018-156002

(51) Int. Cl.

| | |
|---|---|
| ***G08B 6/00*** | (2006.01) |
| ***B25F 5/00*** | (2006.01) |
| ***B25F 5/02*** | (2006.01) |
| ***G08B 21/18*** | (2006.01) |
| ***B25B 21/02*** | (2006.01) |
| ***B25C 1/00*** | (2006.01) |
| ***B25C 1/04*** | (2006.01) |
| ***B25C 1/08*** | (2006.01) |
| ***B25C 5/15*** | (2006.01) |

(52) U.S. Cl.

CPC ..... *G08B 6/00* (2013.01); *B25F 5/00* (2013.01); *B25F 5/02* (2013.01); *G08B 21/18* (2013.01); *B25B 21/02* (2013.01); *B25C 1/008* (2013.01); *B25C 1/047* (2013.01); *B25C 1/08* (2013.01); *B25C 5/15* (2013.01)

(58) Field of Classification Search

CPC ... B25F 5/00; B25F 5/02; B25C 1/008; B25C 1/047; B25C 1/08; B25C 5/15; G08B 6/00; G08B 21/18

USPC ..... 173/20

See application file for complete search history.

(56) References Cited

U.S. PATENT DOCUMENTS 4,958,541 A * 9/1990 Annis ..... B25B 23/1425 81/479
7,431,682 B2 * 10/2008 Zeiler ..... B23B 45/00 483/9
2005/0275508 A1 * 12/2005 Orr ..... G08B 6/00 340/407.1

(Continued)

FOREIGN PATENT DOCUMENTS

JP 2009-184075 A 8/2009
WO 2014/061807 A1 4/2014

OTHER PUBLICATIONS

European Search Report issued in Application No. 18202504.9, dated Apr. 1, 2019, 9 pages.

*Primary Examiner* — Dariush Seif
(74) *Attorney, Agent, or Firm* — Rothwell, Figg, Ernst & Manbeck, P.C.

(57) ABSTRACT

A tool is portable and is to be used with a grip of the tool gripped thereon. The tool includes a vibration generating device. The vibration generating device is configured to generate vibration to notify a state of a machine. The vibration generating device is disposed inside the grip. The vibration generating device is disposed to vibrate in a direction substantially orthogonal to an axial direction of the grip.

20 Claims, 7 Drawing Sheets

| CONTENT | LIGHT SOURCE | SOUND SOURCE | VIBRATION MOTOR |
|---|---|---|---|
| A | ○ | × | × |
| B | ○ | ○ | × |
| C | ○ | ○ | ○ |

| LIGHT SOURCE |
|---|
| ON |
| OFF |

| SOUND SOURCE |
|---|
| ON |
| OFF |

| VIBRATION MOTOR |
|---|
| ON |
| OFF |

(56) References Cited

U.S. PATENT DOCUMENTS

| | | | | |
|---|---|---|---|---|
| 2006/0070459 | A1* | 4/2006 | Kugler | B25B 21/00 73/862.21 |
| 2010/0294824 | A1* | 11/2010 | Takemura | B25B 21/00 227/3 |
| 2011/0074594 | A1* | 3/2011 | Dycus | H01M 2/34 340/679 |
| 2011/0114347 | A1* | 5/2011 | Kasuya | B25D 11/005 173/11 |
| 2012/0267135 | A1* | 10/2012 | Roser | A61C 1/07 173/20 |
| 2013/0056235 | A1* | 3/2013 | Pozgay | B25B 21/00 173/29 |
| 2013/0106756 | A1* | 5/2013 | Kono | G06F 1/3215 345/173 |
| 2013/0207791 | A1* | 8/2013 | Olsson | G01V 3/12 340/407.1 |
| 2016/0167186 | A1* | 6/2016 | Chan | B25F 5/00 173/2 |
| 2017/0176973 | A1* | 6/2017 | Esenwein | H04W 4/026 |
| 2017/0221325 | A1* | 8/2017 | Cruz-Hernandez | G08B 6/00 |
| 2019/0006962 | A1* | 1/2019 | Lu | G06F 3/016 |

* cited by examiner

| CONTENT | LIGHT SOURCE | SOUND SOURCE | VIBRATION MOTOR |
|---|---|---|---|
| A | ○ | × | × |
| B | ○ | ○ | × |
| C | ○ | ○ | ○ |

| LIGHT SOURCE |
|---|
| ON |
| OFF |

| SOUND SOURCE |
|---|
| ON |
| OFF |

| VIBRATION MOTOR |
|---|
| ON |
| OFF |

TOOL AND ELECTRIC TOOL

CROSS-REFERENCE TO RELATED APPLICATIONS

This application is based on and claims priority under 35 USC 119 from Japanese Patent Application Nos. 2017-206760 filed on Oct. 26, 2017, and 2018-156002 filed on Aug. 23, 2018, the contents of which are incorporated herein by reference.

TECHNICAL FIELD

The present invention relates to a tool and an electric tool provided with ways for notifying a state of a machine.

BACKGROUND ART

A conventional electric tool notifies a state (for example, a remaining amount of consumables and occurrence of errors) of a machine by lighting up/blinking an LED or by sounding a buzzer (see, for example, JP-A-2009-184075).

SUMMARY OF INVENTION

Problems to be Solved by the Invention

However, in a case where the LED and the buzzer are used as in the related art, an operator may not notice the notification due to on a working environment. For example, in the case of the LED, there is a problem that it is difficult to distinguish a lighting state in a bright work environment such as an outdoor environment. In the case of the buzzer, there is a problem that it is difficult to listen to a sound in a working environment with a high noise level.

When the operator continues working without noticing the notification, the work efficiency decreases and the risk of machine failure increases. For example, in a case where the operator does not notice the notification even if insufficiency of the remaining amount of the consumables is notified, there are concerns that the consumables may be run out at an incomplete timing and interruption or redoing of work may occur. In addition, in a case where the operator does not notice abnormality such as a high temperature or motor lock of the machine, there is a concern that the risk of failure of the machine may increase. Further, in a case where the operator does not notice a low remaining battery capacity, there is a concern that a battery pack may be used in an over-discharged state, which may lead to a reduction in battery life.

Accordingly, an object of the present invention is to provide a tool and an electric tool that are easily for an operator to notice notification of information even in a bright work environment or a work environment with a high noise level.

Means for Solving Problems

In order to solve the above problems, a tool or an electric tool according to the present invention is portable and is to be used with a grip gripped thereon, and includes a vibration generating device for generating vibration to notify a state of a machine.

Effects of Invention

The present invention is as described above, and includes the vibration generating device that generates the vibration to notify the state of the machine. Therefore, the operator can notice information by the vibration of the vibration generating device even in a bright work environment or a work environment with a high noise level. In addition, the operator has an unnatural feeling intuitively by using the vibration, so that the notification can be noticed sensuously.

DESCRIPTION OF EMBODIMENTS

Hereinafter, embodiments of the present invention will be described with reference to the drawings. In the following description, as an electric tool 10, a driving tool for injecting a fastener (in the present embodiment, a U-shaped staple needle) from an injection port 20*a* will be described as an example. However, the driving tool is only an example of the electric tool 10. The electric tool 10 to which the present invention can be applied is at least an electric tool 10 that is portable and is to be used with a grip 21 gripped thereon, and a type of the electric tool 10 is not particularly limited.

Figure 1:
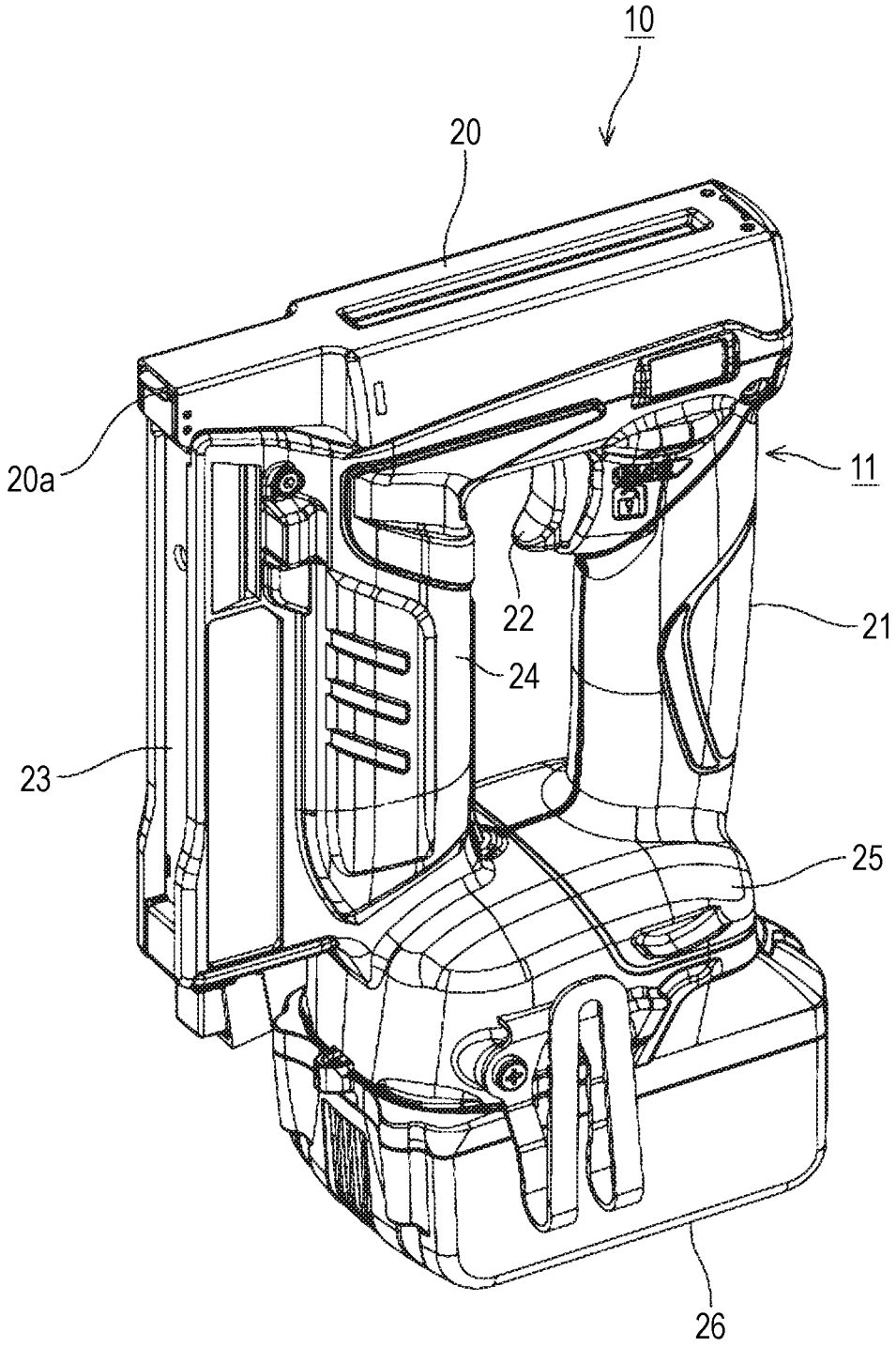
FIG. 1 is a perspective view of an electric tool.

As shown in FIG. 1, the electric tool according to the present embodiment is covered with a housing 11. The electric tool 10 includes an output portion 20, the grip 21, a magazine 23, a motor housing portion 24, and a battery mounting portion 25.

The output portion 20 is a portion that houses a driver (not shown) for striking out the fastener. The driver can slide in a longitudinal direction of the output portion 20. At a tip end of the output portion 20, the injection port 20*a* is opened, and the fastener before being striking out is standby in front of the injection port 20*a*. When a trigger 22 to be described later is operated and the driver slides in a direction of the injection port 20*a*, the fastener standby in front of the injection port 20*a* is struck out by the driver from the injection port 20*a* and driven into a material to be driven.

The grip 21 is a rod-shaped portion that an operator grasps when using the electric tool 10. The grip 21 is connected so as to be substantially orthogonal to the output portion 20. Specifically, the grip 21 is connected to a rear side of the output portion 20 when the output portion 20 is viewed in a striking-out direction of the fastener. The grip 21 is provided with the trigger 22 for operating the electric tool 10. The trigger 22 is disposed at a position where an index finger is applied when the operator grips the grip 21. When the operator pulls the trigger 22, a microswitch 22*a* (see FIG. 2) incorporated in the grip 21 is turned on. When the microswitch 22*a* is turned on, an electric signal is transmitted to a control board 27, a motor 24*a* is driven and controlled by the control board 27, the electric tool 10 is operated, and the fastener is driven in.

In addition, a vibration generating device for generating vibration to notify a state of the machine is disposed inside the grip 21. The vibration generating device according to the present embodiment is configured by attaching a weight to a rotation axis of a vibration motor 35. The weight is attached such that a center of gravity thereof is biased with respect to the rotation axis of the vibration motor 35, and when the vibration motor 35 rotates, vibration is generated by the vibration force of the weight.

Figure 3:
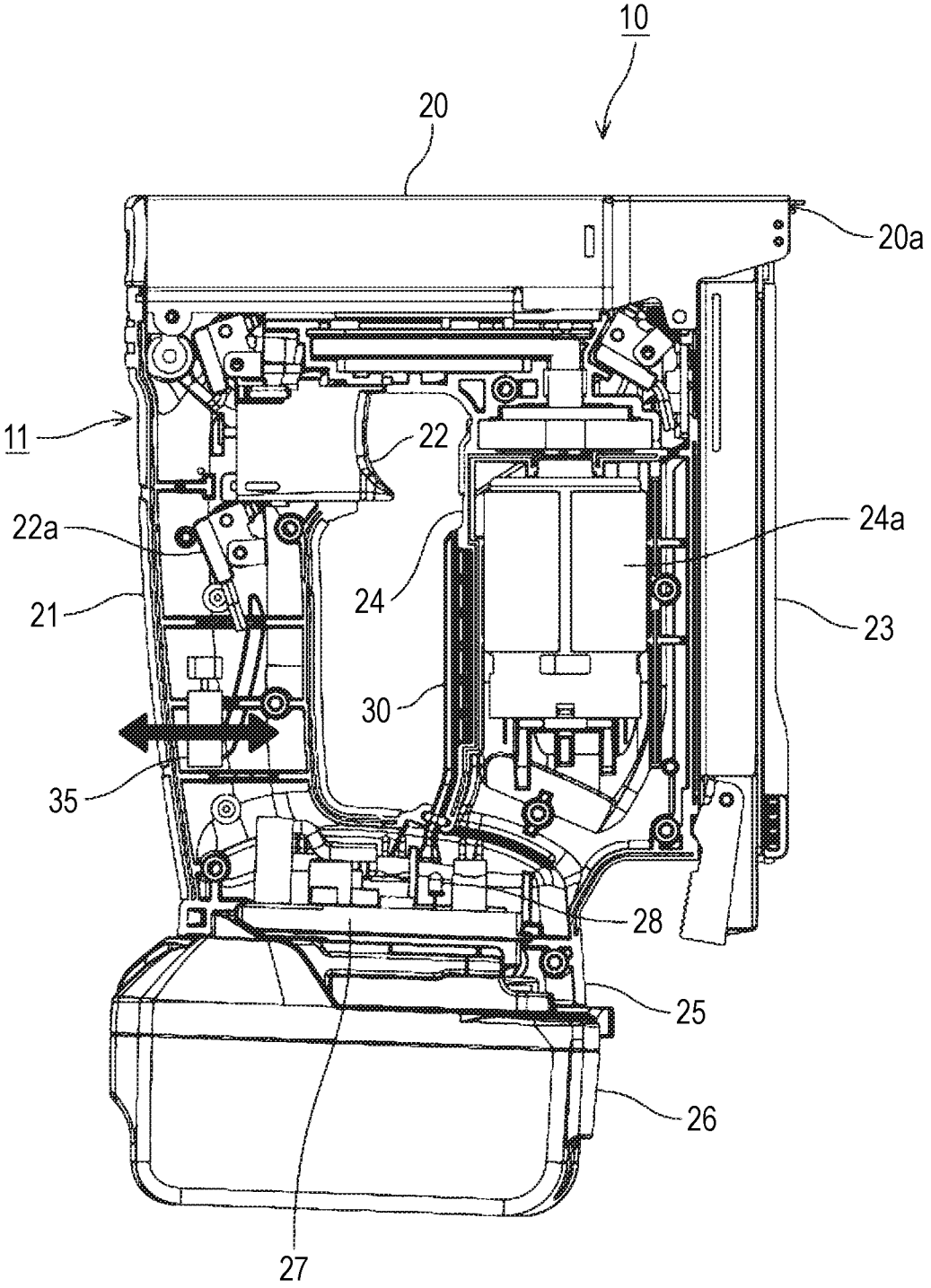
FIG. 3 is a sectional view of the electric tool.

As indicated by arrows in FIG. 3, the vibration motor 35 is disposed to vibrate in a direction substantially orthogonal to an axial direction of the grip 21. In other words, the rotation axis of the vibration motor 35 is disposed substantially parallel to the axial direction of the grip 21. Due to such a disposition, the vibration is easily transmitted to a hand holding the grip 21.

The magazine 23 is a portion for loading the fastener. In the present embodiment, the magazine 23 can be loaded with a coupled fastener in which fasteners are connected in a rod shape. The magazine 23 is connected so as to be substantially orthogonal to the output portion 20, and is disposed substantially in parallel with the grip 21. Specifically, the magazine 23 is connected to a front side of the output portion 20 when the output portion 20 is viewed in the striking-out direction of the fastener. A tip end of the magazine 23 is in connection with an inside of the output portion 20, and is capable of supplying the fastener to the tip end of the output portion 20 (near the injection port 20*a*).

The motor housing portion 24 is provided adjacent to the magazine 23, and houses the motor 24*a* as shown in FIG. 3. The motor 24*a* is a drive source for operating the electric tool 10, and the rotation of the motor 24*a* is controlled by the control board 27 to be described later. In the present embodiment, by rotating the motor 24*a*, the driver performs a driving operation and the driver returns to the standby position.

A light guide portion 30 for guiding light of a light source 28 to be described later is provided on an inner surface (a surface facing the grip 21) of the motor housing portion 24. The light guide portion 30 is made of a transparent or semi-transparent resin, and is a member that allows the light of the light source 28 to be incident and diffuses the incident light internally such that the light can be emitted on the surface. The light guide portion 30 is configured such that the light of the light source 28 can be easily seen by the operator.

The battery mounting portion 25 is a portion for making a battery pack 26 detachable. The battery mounting portion 25 is provided at a lower end of the grip 21 (an end portion on a side opposite to the output portion 20). In other words, the output portion 20 is connected to one end portion of the grip 21, and the battery mounting portion 25 is connected to the other end portion of the grip 21.

In the present embodiment, the battery pack 26 can be attached to and detached from a lower surface of the battery mounting portion 25 by sliding the battery pack 26. Although not specifically shown, a latch is provided on an upper surface of the battery pack 26. When the latch is engaged with a lower surface of the battery mounting portion 25, the battery pack 26 is attached to the electric tool 10. When the battery pack 26 is attached to the electric tool 10, the battery pack 26 and the electric tool 10 are electrically connected, and the electric power stored in the battery pack 26 can be used by the electric tool 10.

The control board 27 for controlling the operation of the electric tool 10 is incorporated in the battery mounting portion 25. As shown in FIG. 3, a front surface of the control board 27 faces a grip 21 side and a back surface thereof faces a battery pack 26 side. On the front surface facing the grip 21 side, various electronic parts are mounted, for example, the light source 28 constituted by a LED and a sound source constituted by a buzzer are mounted. On the back surface facing the battery pack 26 side, terminals for electrically connecting to the battery pack 26 are provided.

The light source 28 mounted on the control board 27 is controlled to be lighting up to notify the state of the machine. The sound source mounted on the control board 27 is controlled to be output to notify the state of the machine. Further, as described above, the vibration motor 35 vibrates in order to notify the state of the machine. Accordingly, in the electric tool 10 according to the present embodiment, the state of the machine can be notified by a plurality of notification ways including the vibration motor 35, the light source 28, and the sound source.

The plurality of notification ways notify, for example, a state of the remaining amount of the fastener, a charge state of the battery pack 26, a temperature state of the battery pack 26, an abnormal state of the machine, or the like. The notification of the state of the remaining amount of the fastener is a notification to be performed when it is detected that the fastener in the magazine 23 has decreased. The notification of the charge state of the battery pack 26 is a notification to be performed when it is detected that the charge of the battery pack 26 is lowered. The notification of the temperature state of the battery pack 26 is a notification to be performed when it is detected that the battery pack is heated to a high temperature. The notification of the abnormal state of the machine is a notification to be performed in a case where a machine abnormality is detected, such as when the machine is heated to a high temperature or when the motor 24*a* is locked.

Accordingly, in the present embodiment, a plurality of notification ways and a plurality of notification contents (the state of the remaining amount of the fastener, the charge state of the battery pack 26, and the abnormal state of the machine) are provided. In such an embodiment, which one of the plurality of notification ways is to be used can be automatically switched according to the notification contents.

Figures 4A, 4B, 4C:
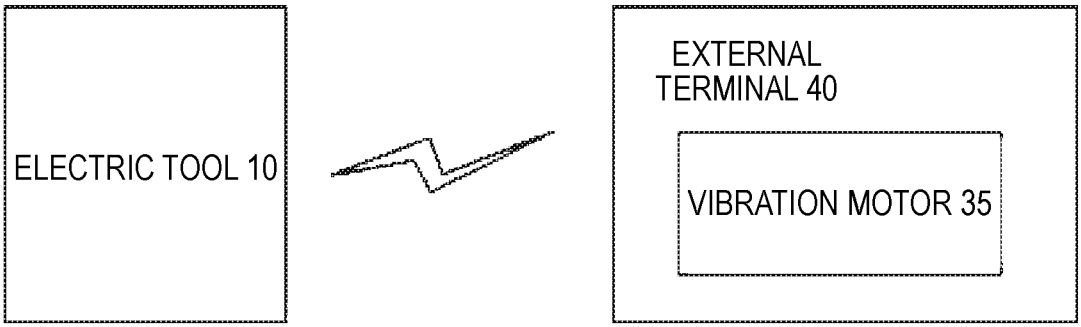
FIG. 4A is a diagram showing a combination of notification ways in a case of switching the notification ways according to a notification content.
FIG. 4B is a diagram showing a combination of setting in a case where the notification ways can be manually switched.
FIG. 4C is a diagram showing a system configuration in a case where a vibration motor is incorporated in an external terminal.

For example, as shown in FIG. 4A, in a case where the notification content is "A" (for example, the notification of the state of the remaining amount of the fastener), the notification may be performed by lighting up or blinking the light source 28 and the sound source and the vibration motor 35 are not operated. In a case where the notification content is "B" (for example, the notification of the charge state of the battery pack 26), in addition to lighting up or blinking the light source 28, the notification may be performed by outputting sound from the sound source, and the vibration motor 35 is not operated. In a case where the notification content is "C" (for example, the notification of the abnormal state of the machine), in addition to lighting up or blinking the light source 28, the notification may be performed by outputting the sound from the sound source and making vibration by vibrating the vibration motor 35.

Accordingly, if the notification ways operating according to the notifying content are made different, the state of the machine can be grasped depending on which one of the notification ways is activated. The mode shown in FIG. 4A is merely an example, and it may be expected to arbitrarily set the combination of the notification ways and the setting of the notification content.

In addition, when notifying the state of the machine, one of the plurality of notification ways to be used can be manually switched by manipulating a switch or the like attached to a main body of the electric tool 10.

For example, as shown in FIG. 4B, the operator may switch whether to use the light source 28, the sound source, or the vibration motor 35 for notification. At this time, switches for switching ON/OFF of the notification of the light source 28, the sound source, and the vibration motor 35 may be respectively provided so as to be operable. For example, in a case where the light source 28 and the sound source are turned on and the vibration motor 35 is turned off, when the electric tool 10 notifies the state of some kinds of machine, the notification is performed using the light source 28 and the sound source without operating the vibration motor 35.

Accordingly, if one of the plurality of notification ways to be used can be manually switched, the notification ways can be selected according to the preference of the operator and the working environment. In the above example shown in FIG. 4A, ON/OFF can be selected for all the notification ways, but it is not limited thereto and ON/OFF may be selected only for some of the notification ways. For example, the light source 28 and the sound source are always on, and the ON/OFF state of the vibration motor 35 may be switched.

In the above embodiment, the vibration motor 35 and the sound source are incorporated in the electric tool 10. However, the embodiment of the present invention is not limited thereto, and the vibration motor 35 and the sound source may be incorporated in an external terminal 40 that is wirelessly connected to the electric tool 10. That is, as shown in FIG. 4C, the external terminal 40 such as a mobile phone incorporated with the vibration motor 35 and the sound source is wirelessly connected to the electric tool 10 by using a Bluetooth (registered trademark) interface or the like. Then, in a case of notifying the state of the machine, a signal is wirelessly output from the electric tool 10 to the external terminal 40, and the external terminal 40 that has received the signal vibrates the vibration motor 35 of the external terminal 40. Further, the external terminal 40 that has received the signal may output the sound from the sound source of the external terminal 40, together with the vibration or instead of the vibration. According to such a configuration, the state of the machine can be notified by vibrating the external terminal 40 which the operator has (or by outputting the sound from the sound source of the external terminal 40).

As described above, according to the present embodiment, a vibration generating device (vibration motor 35) that vibrates to notify the state of the machine is provided. According to such a configuration, the operator can notice the information by the vibration of the vibration generating device even in an environment difficult to notice the notification by the light source 28 or the sound source, that is, a bright work environment or a work environment with a high noise level. In addition, the operator has an unnatural feeling intuitively by using the vibration, so that the notification can be noticed sensuously.

In addition, since the vibration generating device is disposed inside the grip 21, the vibration can be given directly to the hand of the operator, and the operator can easily notice the notification.

Since the vibration generating device is disposed so as to vibrate in the direction substantially orthogonal to the axial direction of the grip 21, the vibration is easily transmitted to the hand holding the grip 21, and the operator can easily notice the notification.

Figure 2:
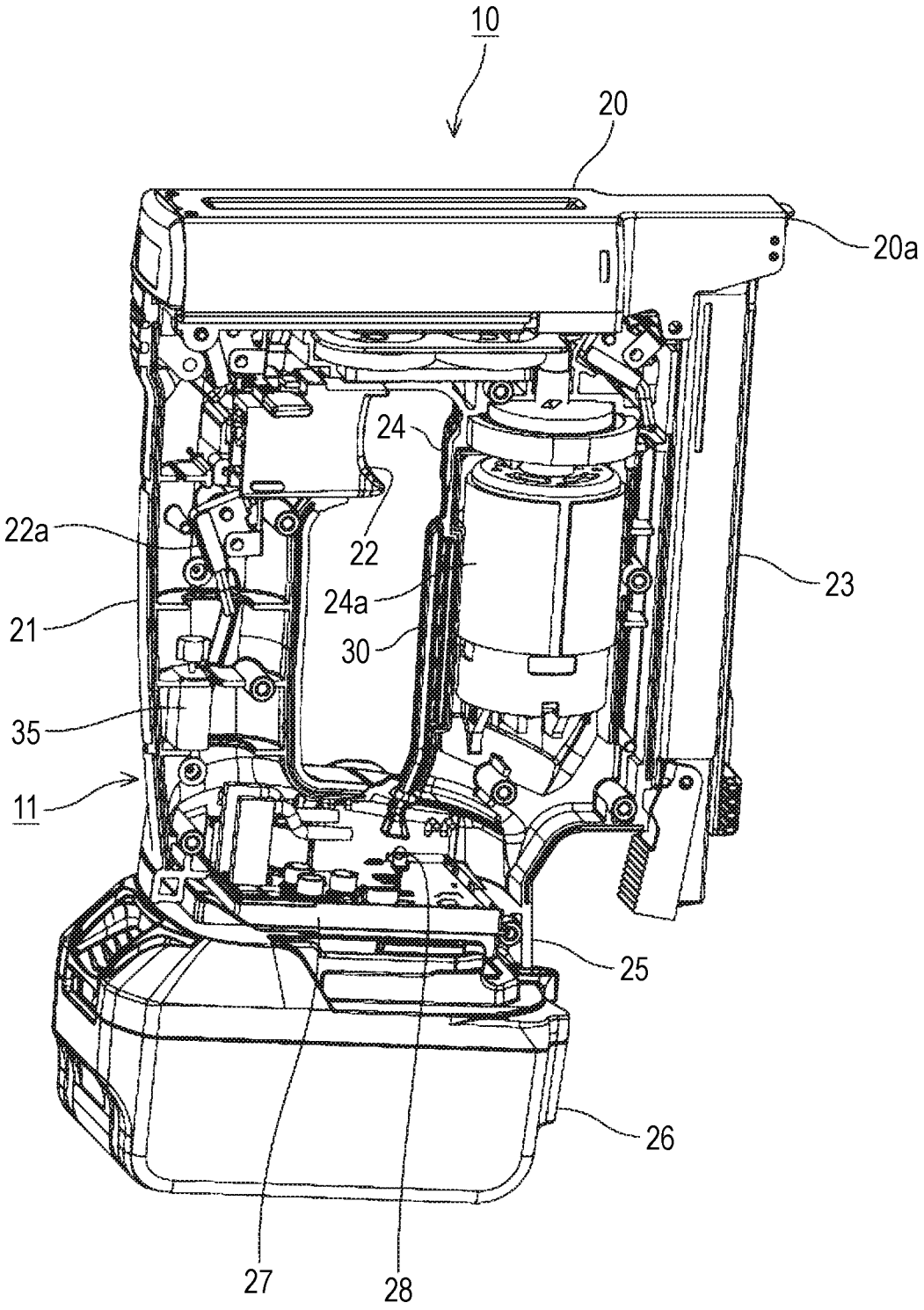
FIG. 2 is a sectional perspective view of the electric tool.

It is desirable that the vibration generating device be disposed inside the grip 21 at a position where the palm of the operator is in contact with when the operator grips the grip 21. By disposing the vibration generating device inside the position with which the palm is in contact, the operator can more easily notice the vibration of the vibration generating device as compared with a case where the vibration generating device is disposed inside the position with which the fingertip is in contact. For example, as shown in FIG. 2, in a case where the axial direction of the grip 21 is substantially orthogonal to an output direction of the electric tool 10 (the striking-out direction of the fastener), the vibration generated by the vibration motor 35 can be easily transmitted to the operator by disposing the vibration motor 35 closer to a front side than a center of the grip 21 as seen in the output direction of the electric tool 10.

In addition, the light source 28 controlled to be lit up to notify the state of the machine and the sound source controlled to be output to notify the state of the machine are provided, and the state of the machine can be notified by the plurality of notification ways including at least two of the vibration motor 35, the light source 28 and the sound source. According to such a configuration, the operator can easily notice the notification by using the plurality of notification ways.

In the above embodiment, the vibration motor 35, the light source 28 and the sound source are provided as the notification ways, but the present invention is not limited thereto, and either the light source 28 or the sound source may not be provided. In addition, notification ways other than these three may also be provided.

In addition, in the above embodiment, the vibration generating device (vibration motor 35) is provided in the electric tool 10 using the motor 24*a* as a drive source, but the present invention is not limited thereto, and a vibration generating device may be provided in a tool operated by a different drive source.

Figure 5:
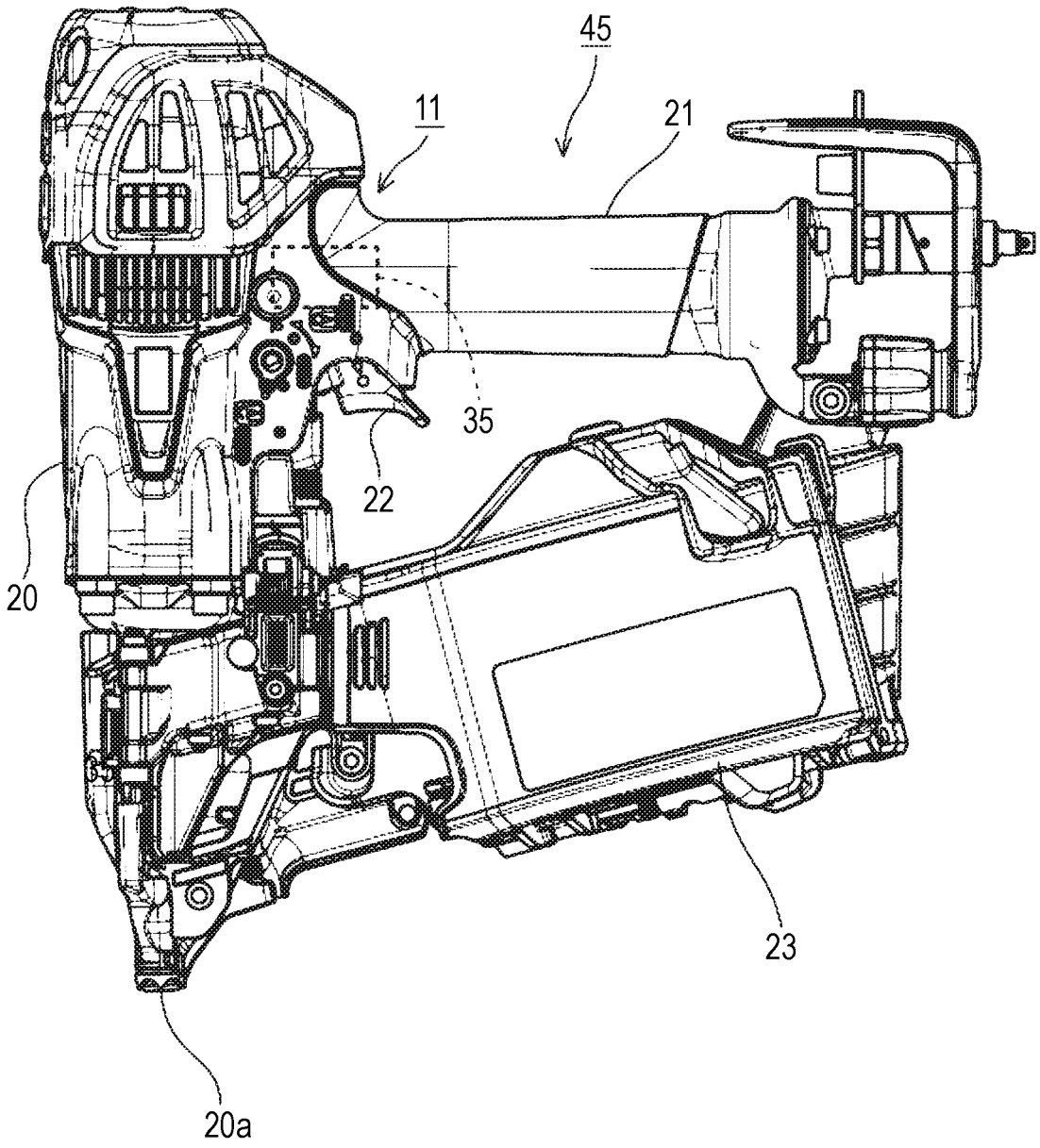
FIG. 5 is a side view of a pneumatic tool according to a first modification.

For example, FIG. 5 shows a pneumatic tool 45 according to a first modification. The pneumatic tool 45 shown in the first modification is a nailing machine that drives a driving mechanism using compressed air. If such a pneumatic tool 45 is provided with a vibration generating device, for example, the notification that the remaining amount of consumables such as a fastener has decreased, the notification of abnormality of a tool, the notification of operation of a safety device, or the like can be performed by the vibration generating device.

Since the grip 21 is often used as a pressure vessel in the pneumatic tool 45, it is desirable that the vibration motor 35 be disposed near the grip 21 (for example, so as to cross through a boundary between the grip 21 and the output portion 20).

In addition, the pneumatic tool 45 generally does not use electricity. Therefore, it is necessary to incorporate a battery for driving the vibration motor 35. However, since the vibration motor 35 for information transmission is sufficiently small, a small battery is also sufficiently small, and a vibration generating device including the vibration motor 35 and a battery can be mounted. Accordingly, the vibration generating device can be mounted even with a tool that does not use electricity.

Figure 6:
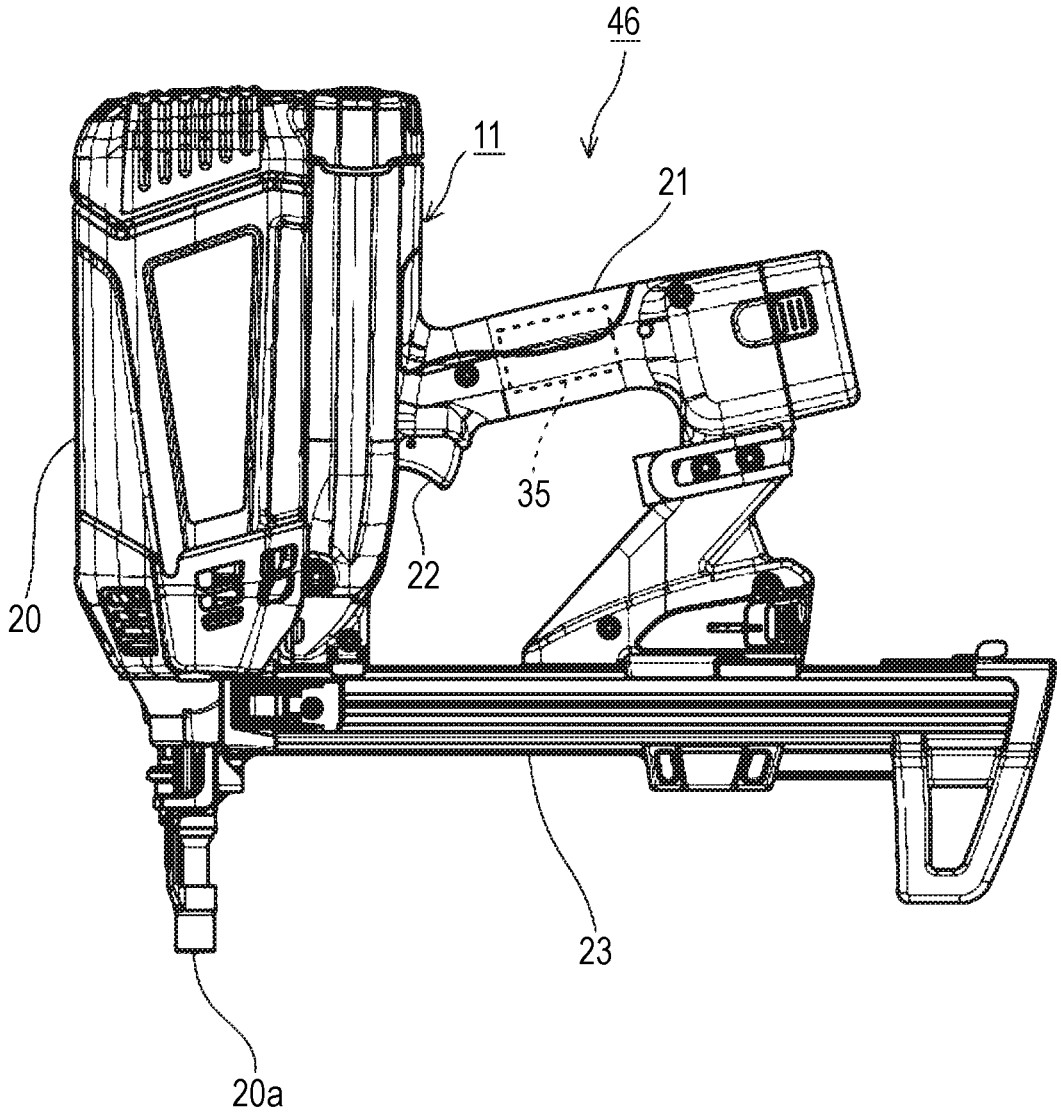
FIG. 6 is a side view of a gas combustion type nailing machine according to a second modification.

FIG. 6 shows a gas combustion type nailing machine 46 according to a second modification. The tool shown in the second modification is a nailing machine that drives a driving mechanism by gas combustion pressure. If such a gas combustion type nailing machine 46 is provided with a vibration generating device, for example, the notification that the remaining amount of consumables such as a fastener has decreased, the notification that the battery level is low, the notification of abnormality of a tool, the notification of operation of a safety device, or the like can be performed by the vibration generating device.

Since a fan for stirring fuel or a battery for driving an ignition device are mounted in the gas combustion type nailing machine 46, it is unnecessary to add a battery for driving the vibration motor 35. Therefore, the vibration generating device can be mounted without increasing the size of the tool.

In the above embodiment, an example in which the vibration generating device (vibration motor 35) is provided on a tool that uses consumables such as a fastener has been described. However, the present invention is not limited thereto, and a vibration generating device may be provided in a tool that does not use the consumables.

Figure 7:
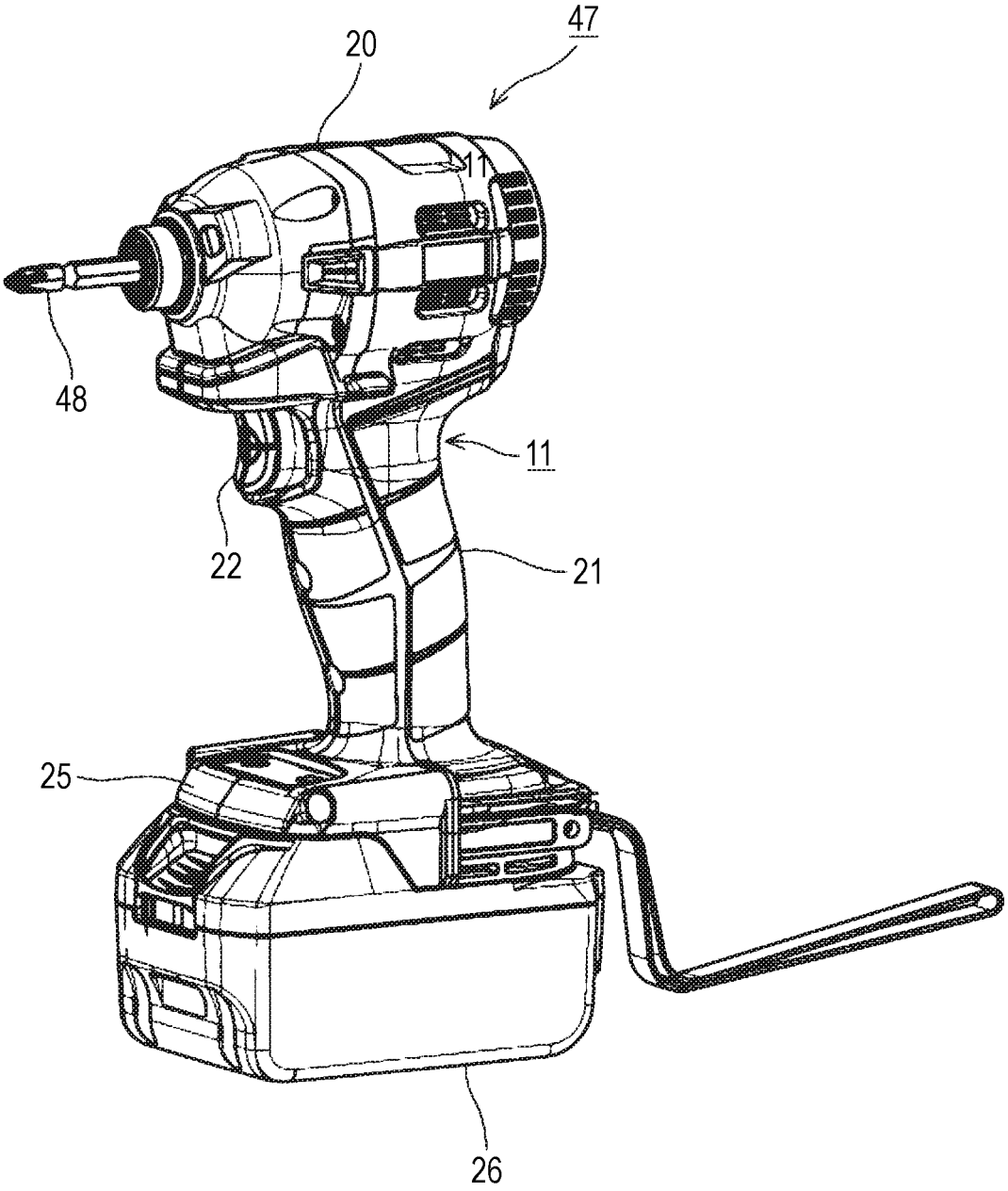
FIG. 7 is an external view of an impact driver according to a third modification.

For example, FIG. 7 shows an impact driver 47 according to a third modification. The impact driver 47 according to the third modification converts a rotational energy of the motor 24*a* into a striking force and a rotational force, and transmits the striking force and the rotational force to a driver bit 48 attached to the tip end of the output portion 20, thereby tightening a screw or a bolt. Even having a tool, like the impact driver 47, which does not use the consumables such as a fastener like the impact driver 47, the notification of abnormality of a tool, the notification of operation of a safety device, or the like can be performed by providing a vibration generating device.

What is claimed is:

1. A tool which is portable and which is to be used with a grip of the tool gripped thereon, comprising:

a vibration generating device that is configured to generate vibration to notify a condition of a machine; and at least one of a light source that is configured to be lit up to notify the condition of the machine, and a sound source that is configured to output sound to notify the condition of the machine, wherein the condition of the machine is notified by at least two of the vibration generating device, the light source and the sound source, and wherein notification content is determined by interrelated combined selective actuation or non-actuation of at least two different types of indicator devices among the vibration generating device, the light source and the sound source and interrelated combined selective actuation and non-actuation of the at least two different types of indicator devices identifies the notification content such that a first condition is indicated by a first indication set including combined selective actuation or non-actuation of at least two different types of indicator devices, and a second condition different from the first condition is indicated by a second indication set including combined selective actuation or non-actuation of at least two different types of indicator devices and the second indication set is different from the first indication set.

2. The tool according to claim 1, wherein the vibration generating device is disposed inside the grip.

3. The tool according to claim 1, wherein the vibration generating device is disposed to vibrate in a direction substantially orthogonal to an axial direction of the grip.

4. The tool according to claim 1, wherein at least one of the vibration generating device, the light source and the sound source is manually selected.

5. The tool according to claim 1, wherein another vibration generating device is incorporated in an external terminal wirelessly connected to the tool.

6. The tool according to claim 1, wherein the vibration generating device generates the vibration by rotation of a motor.

7. A tool according to claim 1, further including a control board which actuates the vibration generating device and the at least one of the light source and the sound source according to at least the first condition and the second condition of the tool; and wherein the first condition and the second condition correspond to two different conditions from among: a battery charge state, a fastener supply level in the tool, an operating temperature, or a locking of the tool.

8. A tool according to claim 7, wherein for one of the first condition or the second condition, both the vibration generating device and at least one of the light source or the sound source are actuated.

9. An electric tool which is portable and which is to be used with a grip of the tool gripped thereon, comprising:

a vibration generating device that is configured to generate vibration to notify a condition of a machine; and at least one of a light source that is configured to be lit up to notify the condition of the machine, and a sound source that is configured to output sound to notify the condition of the machine, wherein the condition of the machine is notified by at least two of the vibration generating device, the light source and the sound source, and wherein notification content is determined by interrelated combined selective actuation or non-actuation of at least two different types of indicator devices among the vibration generating device, the light source and the sound source and interrelated combined selective actuation and non-actuation of the at least two different types of indicator devices identifies the notification content such that a first condition is indicated by a first indication set including combined selective actuation or non-actuation of at least two different types of indicator devices, and a second condition different from the first condition is indicated by a second indication set including combined selective actuation or non-actuation of at least two different types of indicator devices and the second indication set is different from the first indication set.

10. The electric tool according to claim 9, wherein the vibration generating device is disposed inside the grip.

11. The electric tool according to claim 10, wherein the vibration generating device is disposed to vibrate in a direction substantially orthogonal to an axial direction of the grip.

12. The electric tool according to claim 9, wherein at least one of the vibration generating device, the light source and the sound source is manually selected.

13. The electric tool according to claim 9, wherein another vibration generating device is incorporated in an external terminal wirelessly connected to the electric tool.

14. The electric tool according to claim 9, wherein the vibration generating device generates the vibration by rotation of a motor.

15. The electric tool according to claim 9, further including a control board which actuates the vibration generating device and the at least one of the light source and the sound source according to at least the first condition and the second condition of the tool; and wherein the first condition and the second condition correspond to two different conditions from among: a battery charge state, a fastener supply level in the tool, an operating temperature, or a locking of the tool.

16. The electric tool according to claim 15, wherein for one of the first condition or the second condition, both the vibration generating device and at least one of the light source or the sound source are actuated.

17. A tool which is portable and having a grip thereon, comprising:

a control board which actuates at least two different types of indicator devices to indicate at least two different conditions of the tool, such that the interrelated combined actuation or non-actuation of at least two different types of indicator devices identify at least a first condition and a second condition of the tool, wherein a first indication set from among the at least two different types of indicator devices actuated for the first condition is different than a second indication set from among the at least two different types of indicator devices actuated for the second state;

wherein the at least two different types of indicator devices include at least two different types of indicator devices from among a vibration generating device, a light source, and a sound source and interrelated combined selective actuation or non-actuation of the at least two different indicator devices provides notification content identifying the first condition or the second condition; and wherein the first condition and the second condition correspond to two different conditions from among: a battery charge state, a fastener supply level in the tool, an operating temperature, or a locking of the tool.

18. The tool according to claim 17, wherein for the second condition, two of the at least two different types of indicator devices are actuated, and for the first condition, only one of the at least two different types of indicator devices is actuated.

19. The tool according to claim 18, wherein the at least two different types of indicator devices comprise three different types of indicator devices, including each of the light source, the vibration generating device and the sound source; and the control board is configured to selectively actuate the three different types of indicator devices according to a third condition by actuating a third set of the three different types of indicator devices different from the first set and the second set.

20. The tool according to claim 17, wherein one of the at least two different types of indicator devices is mounted to the tool, and one of the at least two different types of indicator devices is separate from the tool and wirelessly communicates with the control board.

* * * * *